US011576843B2

(12) United States Patent
Piraud et al.

(10) Patent No.: US 11,576,843 B2
(45) Date of Patent: Feb. 14, 2023

(54) VESSEL FOR A FLUID HAVING A SILICONE CONTINUITY

(71) Applicant: K INVESTISSEMENTS INDUSTRIELS, Chirens (FR)

(72) Inventors: Vincent Piraud, Chirens (FR); Allison Piraud, Chirens (FR)

(73) Assignee: K INVESTISSEMENTS INDUSTRIELS, Chirens (FR)

( * ) Notice: Subject to any disclaimer, the term of this patent is extended or adjusted under 35 U.S.C. 154(b) by 67 days.

(21) Appl. No.: 17/272,120

(22) PCT Filed: Aug. 29, 2019

(86) PCT No.: PCT/FR2019/051992

§ 371 (c)(1),
(2) Date: Feb. 26, 2021

(87) PCT Pub. No.: WO2020/043991

PCT Pub. Date: Mar. 5, 2020

(65) Prior Publication Data

US 2021/0322276 A1 Oct. 21, 2021

(30) Foreign Application Priority Data

Aug. 29, 2018 (FR) ..... 18/57759

(51) Int. Cl.
*A61J 9/00* (2006.01)
*A61J 11/00* (2006.01)
*A61J 11/04* (2006.01)

(52) U.S. Cl.
CPC ..... *A61J 9/005* (2013.01); *A61J 11/008* (2013.01); *A61J 11/04* (2013.01)

(58) Field of Classification Search
CPC ..... A61J 9/005; A61J 11/04
(Continued)

(56) References Cited

U.S. PATENT DOCUMENTS

2004/0065635 A1* 4/2004 Turnbough ..... A61J 11/045 215/396
2013/0327737 A1* 12/2013 Lee ..... A61J 11/04 215/11.1

(Continued)

FOREIGN PATENT DOCUMENTS

| | | | |
|---|---|---|---|
| EP | 2679214 | A2 | 1/2014 |
| KR | 101263426 | B1 | 5/2013 |
| TW | M546953 | U | 8/2017 |

OTHER PUBLICATIONS

English Translation to International Search Report for Application No. PCT/FR2019/051992.

(Continued)

*Primary Examiner* — John K Fristoe, Jr.
*Assistant Examiner* — Jennifer Castriotta
(74) *Attorney, Agent, or Firm* — Cantor Colburn LLP

(57) ABSTRACT

A vessel intended to contain a fluid including a container delimiting an inner volume made of a flexible material and topped with a tubular sleeve whose proximal end delimits a housing. The sleeve includes an upper shoulder projecting radially outwards of the sleeve. The vessel also comprises a removable closure device made of a flexible material including a lower shoulder adapted to interact with the upper shoulder of the sleeve so that tightness is ensured when the lower shoulder and the upper shoulder are compressed against one another. The vessel also includes a coupling system enabling holding and mutual compression of the lower shoulder of the removable closure device and of the upper shoulder of the sleeve.

20 Claims, 4 Drawing Sheets

(58) Field of Classification Search
USPC ..... 215/11.1, 11.3
See application file for complete search history.

(56) References Cited

U.S. PATENT DOCUMENTS

2016/0090216 A1* 3/2016 Joyce ..... A61J 11/04
220/288
2018/0256452 A1 9/2018 Chen

OTHER PUBLICATIONS

International Search Report for Application No. PCT/FR2019/051992.
Written Opinion for Application No. PCT/FR2019/051992.

* cited by examiner

Fig. 1
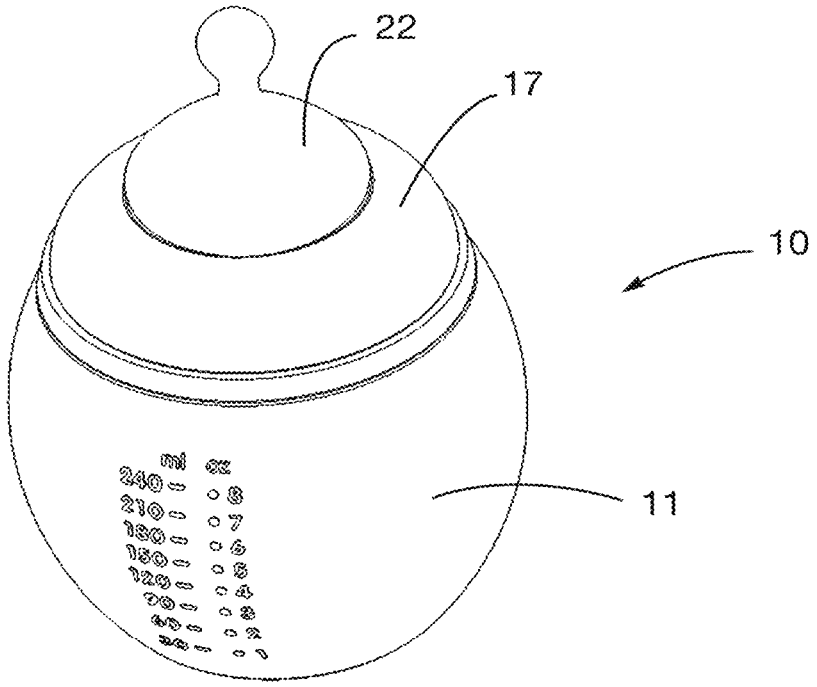
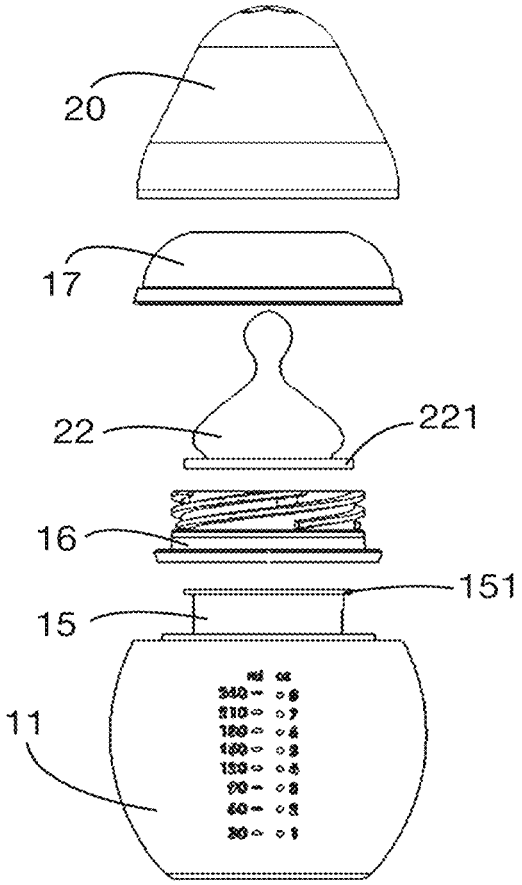
Fig. 2

Fig. 3
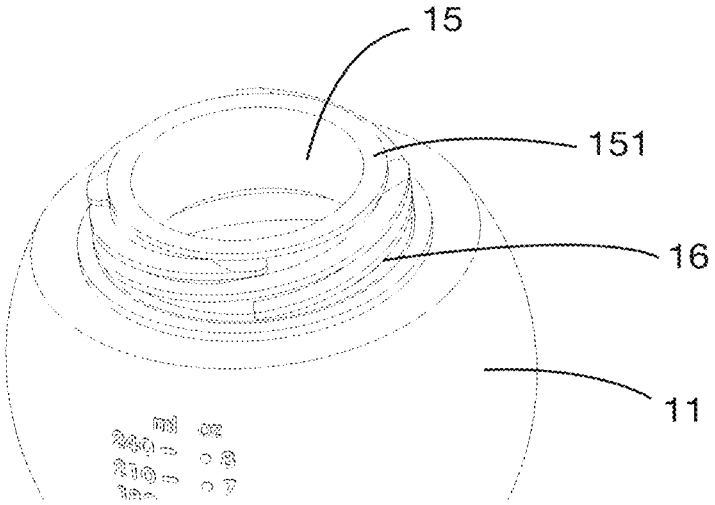
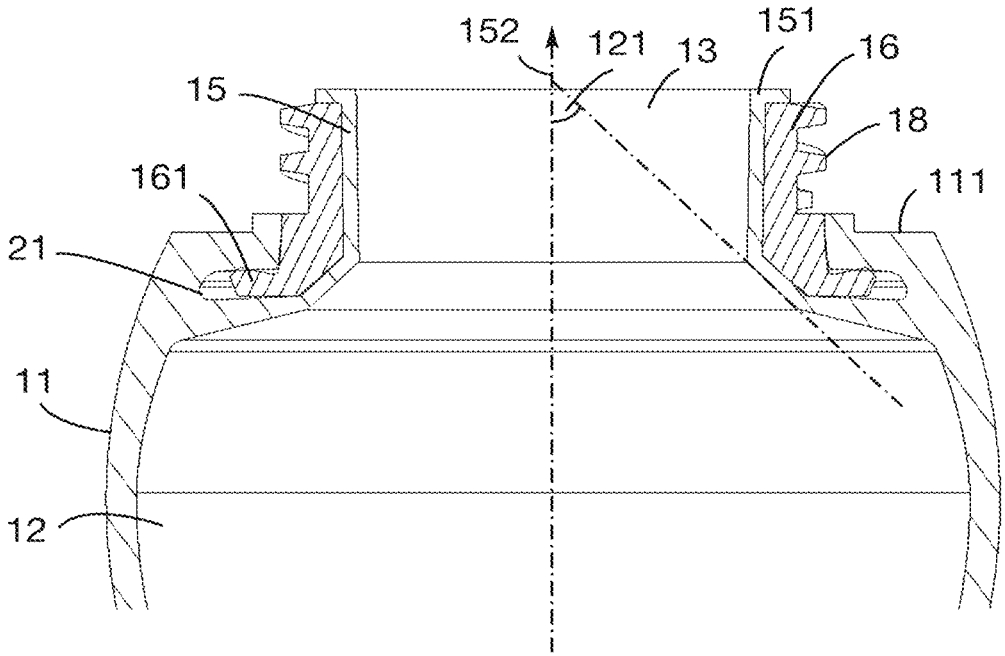
Fig. 4

VESSEL FOR A FLUID HAVING A SILICONE CONTINUITY

CROSS REFERENCE TO RELATED APPLICATIONS

This application is a National Stage of PCT Application No. PCT/FR2019/051992 filed on Aug. 29, 2019, which claims priority to French Patent Application No. 18/57759 filed on Aug. 29, 2018, the contents each of which are incorporated herein by reference thereto.

TECHNICAL FIELD

The present invention concerns a vessel intended to contain a fluid, such as a feeding bottle, a bottle, a flask or a tank for a gas or a liquid.

BACKGROUND

There are currently many vessels made of a flexible material, whose advantage is to avoid having the vessel breaking apart in the event of a drop in contrast with vessels made of glass. These are also light and often easy to handle.

In particular, such vessels may be configured so as to serve as a feeding bottle which, as is known, is a tool that helps infants or young children to ingest liquid preparations for their growth.

Typically, a feeding bottle type vessel comprises a hollow container capable of containing a liquid preparation for a child or an infant, a removable closure device with a suction teat and a system for coupling the teat to the container.

It has already been imagined to manufacture all or part of such a feeding bottle in a silicone, which has the advantage, besides those already indicated hereinabove, that the vessel has a pleasant touch that could call back the texture of the skin in order to contribute to the emotional development of the user, and that the vessel is hygienic by limiting the risks of contamination of the liquid preparation.

In the category of feeding bottles, there are those whose container and system for coupling the teat to the container are integrally made of silicone. Nonetheless, such vessels are inconvenient to use, the excessively high deformability of all parts making some of them difficult to handle and to assemble together.

There are also feeding bottles where only the container thereof is made of a flexible material such as silicone, the coupling system being intentionally made of a rigid material. Nonetheless, such vessels are particularly difficult to manufacture, because of the commonly used technique of overmolding the coupling system with the silicone of the container. Indeed, withdrawal from the mold used during the overmolding of the container on the coupling system is a real difficulty and considerably limits the possible shapes and dimensions of these different parts. In particular, the dimensions of the container shall be maximum at the level of the upper opening, otherwise it would not be possible to unmold it.

Like the solutions described in the documents TWM546953U and KR101263426, it has already been imagined to provide a coupling system including a first ring intended to be inserted into a housing formed in the vessel and fitting around a sleeve delimited by the vessel and a second ring meshing by screwing with the first ring so as to tightly hold the teat against an upper shoulder of the sleeve.

Nonetheless, these solutions are not fully satisfactory in terms of reliability, in particular because of the risks of having the proximal end of the sleeve translating and the first ring taken off with respect to the vessel in the case of a too strong pressure on the vessel.

In addition, feeding bottles made of a flexible material may have the disadvantage of being uneasy to assemble since the assembly parts are difficult to be fastened on the flexible material.

There is also a need to provide a feeding bottle where the contained liquid is in contact with silicone deemed to be safe and with the lowest contact as possible with other portions in particular those pertaining to sealing and tightness which would be made of plastic and therefore potentially contaminated by endocrine disruptors.

There is also a need to provide a container whose inside can be easily cleaned.

Even though the above-mentioned problems are presented in connection with the particular case of a vessel serving as a feeding bottle, these may be associated to other types of vessels such as flasks, bottles or other types of vessels such as some tanks for a liquid or a gas.

In this context, there is a need for providing a vessel intended to contain a fluid (fluid or liquid), such as a feeding bottle, a bottle, a flask or a tank for a gas or a liquid, which is robust, safe and hygienic, convenient to use and to clean, pleasant to touch while being easy to manufacture and merely restrictive with regards to the freedom of design of the container, in terms of shape and dimension.

BRIEF SUMMARY

The present invention aims at providing a vessel intended to contain a fluid, such as a feeding bottle, a bottle, a flask or a tank for a gas or a liquid, having a container made of a flexible material, adapted to solve all or part of the aforementioned drawbacks.

In particular, the object of the invention is to provide such a vessel that is reliable, robust, hygienic, convenient to use and to clean, pleasant to touch, easy to manufacture and to assemble without any risk of crushing of material during tightening of the coupling system, merely restrictive with regards to the freedom of design of the container and offering to the contained liquid a contact surface with the vessel that is potentially made of silicone in its entirety.

This object may be achieved thanks to the provision of a vessel intended to contain a fluid, such as a feeding bottle, a bottle, a flask or a tank for a gas or a liquid, the vessel comprising a container delimiting an inner volume made of a flexible material and topped with a tubular sleeve whose proximal end delimits a housing in combination with the container, and whose distal end delimits an upper opening enabling the flow of the fluid towards or from the inner volume and including an upper shoulder projecting radially outwards of the sleeve, a removable closure device made of a flexible material, and including a lower shoulder adapted to interact with the upper shoulder of the sleeve so that tightness is ensured when the lower shoulder and the upper shoulder are compressed against one another, a coupling system enabling holding and mutual compression of the lower shoulder of the removable closure device and of the upper shoulder of the sleeve, and constituted by the following two parts, independent of each other and both made of a rigid material:

- a first annular ring delimiting a first thread and a collar adapted to be inserted into the housing by elastic deformation of the proximal end of the sleeve, the first annular ring fitting around the sleeve, beneath the upper shoulder, by elastic deformation of the upper shoulder, a second annular ring delimiting a second thread meshing with the first thread by screwing of the second annular ring relative to the first annular ring, so that the lower shoulder of the removable closure device and the upper shoulder of the sleeve are adapted to be tightly held and compressed together between the first annular ring and the second annular ring by the screwing action of the second annular ring on the first annular ring, wherein the container delimits an outer shoulder whose free face is generally orthogonal to the direction of longitudinal extension of the tubular sleeve, and wherein the second annular ring delimits a primary shoulder so that the primary shoulder of the second annular ring bears against the outer shoulder of the container when the second annular ring surrounds the lower shoulder of the removable closure device and the upper shoulder of the sleeve together with the first annular ring.

Some preferred, yet non-limiting, aspects of this vessel are the following ones:

The second thread of the second annular ring is arranged projecting from an internal face of the second annular ring.

The collar of the first annular ring projects from an external face of the first annular ring and the housing is arranged in a plane generally orthogonal to the direction of longitudinal extension of the sleeve so that the collar inserted beforehand into the housing is held blocked against at least one translational movement along the direction of longitudinal extension of the sleeve.

The collar of the first annular ring has a thickness larger than the thickness of the housing considered according to the direction of longitudinal extension so that the walls delimiting the housing are compressed by the collar when the collar of the first annular ring is inserted into the housing such that the first annular ring is held blocked against a rotational movement about the direction of longitudinal extension of the sleeve.

The lower shoulder of the removable closure device includes a planar face and a flange generally orthogonal to the planar face so as to form a hook, and the second annular ring delimits a secondary shoulder away from the primary shoulder and whose shape is complementary to that delimited by the lower shoulder of the removable closure device so that when the second annular ring surrounds the lower shoulder of the removable closure device and the upper shoulder of the sleeve together with the first annular ring, the removable closure device is blocked against at least one translational movement generally perpendicular to the longitudinal axis of extension of the sleeve.

The walls of the tubular sleeve have a thickness smaller than any one of the walls of the container.

The sleeve is adapted to be selectively placed in at least one first raised position where the sleeve is placed outside the container and at least one second folded position where the sleeve is folded inwards of the container.

At least one portion of the inner face of the inner volume of the container arranged towards the proximal end of the sleeve describes a clearance angle larger than 40° with respect to the direction of longitudinal extension of the sleeve.

The removable closure device comprises a teat.

The vessel comprises a cap adapted to be removably mounted on the second annular ring so as to cover the teat, the vessel constituting a feeding bottle intended to contain a liquid for its consumption through the teat.

The container partially delimits a general shape of a cambered cylinder whose generatrix has an arcuate shape such that the container has a maximum diameter substantially halfway-up.

The container includes a support face arranged so as to enable the container to be set on a planar support in a stable way, the support face having a corrugated central shape so that only the periphery of the support face bears on the planar support.

The container and the closure device are made of a silicone.

BRIEF DESCRIPTION OF THE DRAWINGS

Other aspects, objects, advantages and features of the invention will appear better on reading the following detailed description of preferred embodiments thereof, provided as a non-limiting example, and made with reference to the appended drawings in which:

FIG. 1 is a perspective view of an example of a feeding bottle type vessel according to the invention in an assembled state, FIG. 2 is a perspective view of the vessel of FIG. 1 with the cap added, in an exploded state, FIG. 3 represents a perspective view of the container used in the vessel of FIGS. 1 and 2, FIG. 4 represents the first annular ring and the container of the vessel of FIGS. 1, 2 and 3 according to an axial sectional view, in the situation where the first annular ring is placed on the container.

DETAILED DESCRIPTION

Figure 5:
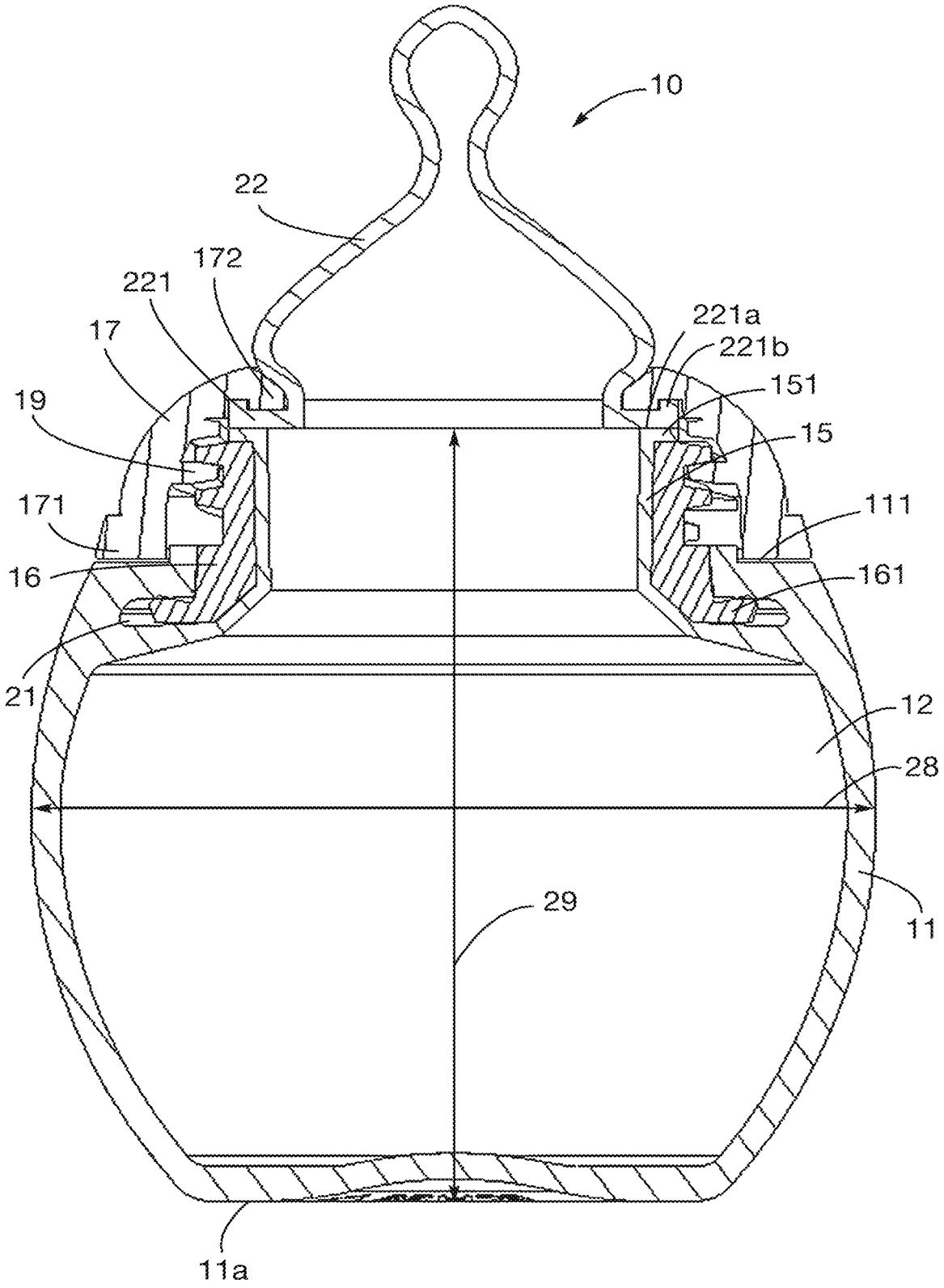
FIG. 5 represents an axial sectional view of the second annular ring as well as the removable closure device used in the vessel of FIGS. 1, 2, 3 and 4 in the situation where the first annular ring and the second annular ring fix the sleeve of the container as well as well as the removable closure device by screwing.

FIGS. 1 to 7 detail an example of a vessel 10 according to the invention. The represented vessel 10 concerns a particular case which does not limit in any manner whatsoever the possible fields of application of the invention.

More specifically, the vessel 10 of FIGS. 1 to 7 is configured, as it will be detailed later on, so as to constitute a feeding bottle capable of containing and delivering in a controlled manner a liquid preparation for a child or an infant, through a teat.

The layout of such a teat does not have any limitation with regards to the shape thereof (whether this is an anatomical shape or not, for example).

Yet, the reader should keep in mind that the invention may indifferently be adapted so as to constitute a vessel such as a flask, a bottle or the same, or a tank for a gas or a liquid, through simple adaptations within the reach of those skilled in the art starting from the principles of the invention that will be set out later on applied to the particular case of a feeding bottle.

Thus, in general, the vessel 10 is intended to contain a fluid (not represented), whether this consists of a liquid typically intended to be consumed or a gas. The vessel is made of a flexible material and comprises a container 11 having a hollow general shape, a bit like a pot, so as to delimit an inner volume 12, topped with a tubular sleeve 15.

The tubular sleeve 15 comprises a proximal end which delimits a housing 21 in combination with the container 11. The tubular sleeve 15 comprises a distal end which delimits an upper opening 13 enabling the flow of the fluid towards or from the inner volume 12. The distal end also includes an upper shoulder 151 projecting radially outwards of the sleeve 15. The upper opening 13 enables the flow of the fluid towards or from the inner volume 12. By <<topped with>>, it should be understood: <<arranged in continuity with the container>>. The tubular sleeve 15 has an axis of symmetry which is also called direction of longitudinal extension 152. This axis is generally aligned on the axis of revolution of the vessel in the case where the latter contains such one.

In the text, the terms <<substantially>> or <<generally>> mean within 10%.

Quite advantageously, the container 11 is made of a flexible material, allowing making the vessel 10 unbreakable and facilitating handling thereof. In particular, but without limitation, the container 11 is made integrally in one-piece of a silicone or a polysiloxane. The advantage of this particular material is that it has a hand touch relatively close to human skin in order to promote the emotional development of the user infant or child, while being hygienic by limiting the risks of contaminations with respect to the contained liquid, these two aspects being essential in the particular case of an application as a feeding bottle. It is still possible to consider other flexible materials adapted to the intended functions of the vessel 10, in particular materials having characteristics similar to those of silicone, for example natural rubbers or a material selected from the list of elastomer thermoplastics.

The vessel 10 also comprises a removable closure device 22 serving to ensure closure of the container 11 in its upper portion, in order to prevent the fluid present in the inner volume 12 from flowing except for a controlled flow through the removable closure device 22, for example in this instance through the aforementioned teat.

The removable closure device 22 includes a lower shoulder 221 adapted to interact with the upper shoulder 151 of the sleeve 15 so that tightness is ensured when the lower shoulder 221 and the upper shoulder 151 are compressed against one another.

In the particular case of the vessel 10 serving as a feeding bottle as is the case in FIGS. 1 to 5, the removable closure device 22 may comprise in particular a teat. Thus, the removable closure device 22 may be made of a flexible material such as that described hereinbefore and preferably of a silicone.

Nevertheless, it is obvious that the nature and the design of the removable closure device will depend on the intended function of the vessel 10. Thus, the removable closure device 22 may be different from the represented one, in particular in the case where the vessel 10 is a bottle, a flask, or another tank for a gas or a liquid.

The vessel 10 also comprises a coupling system serving as an interface between the container 11 and the removable closure device 22. The coupling system is mounted on the container 11 at the level of the upper opening 13 by a mechanical assembly, avoiding the need for overmolding techniques. The coupling system enables holding and mutual compression of the lower shoulder 221 of the removable closure device 22 and of the upper shoulder 151 of the sleeve 15.

The coupling system is constituted by the combination of two parts independent of each other, both made of a rigid material, namely a first annular ring 16 and a second annular ring 17. Advantageously, and for simplicity of manufacture, each of these two parts may in particular be obtained through a molding technique. The used material may be of the metallic type such as for example a steel selected from the list of stainless steels or a brass, or of the plastic-based type such as for example a polypropylene, which is advantageous in the particular case of a vessel 10 intended to serve as a feeding bottle.

The first annular ring 16 delimits a first thread 18 and a collar 161 adapted to be inserted by elastic deformation of the proximal end of the sleeve 15, into the housing 21. The first annular ring 16 fits around the sleeve 15 by elastic deformation of the upper shoulder 151 of the sleeve 15.

In an embodiment illustrated in FIGS. 2, 4 and 5, the collar 161 of the first annular ring 16 projects from an external face of the first annular ring 16 and the housing 21 is arranged in a plane generally orthogonal to the direction of longitudinal extension 152 of the tubular sleeve 15 so that with the collar 161 being inserted beforehand into the housing 21, it is held blocked against at least one translational movement along the direction of longitudinal extension of the tubular sleeve 15. Advantageously, this allows preserving tightness even in the case where the removable closure device 22 is pulled for example if a child wishes to tear off the teat from the feeding bottle.

In another embodiment illustrated in FIGS. 2, 4 and 5, the collar 161 of the first annular ring 16 has a thickness larger than the size of the housing 21 when considered according to the direction of longitudinal extension 152 so that the walls forming the housing 21 are compressed when the collar 161 of the first annular ring 16 is inserted into the housing 21. The result is that the first annular ring 16 is held blocked against at least one rotational movement about the direction of longitudinal extension 152 of the tubular sleeve 15. Advantageously, this prevents the first annular ring 16 from rotating when the second annular ring 17 is screwed thereon.

The second annular ring 17 delimits a second thread 19 meshing with the first thread 18 by screwing of the second annular ring 17 relative to the first annular ring 16, so that the lower shoulder 221 of the removable closure device 22 and the upper shoulder 151 of the sleeve 15 are tightly held and compressed together between the first annular ring 16 and the second annular ring 17 by the screwing action of the second annular ring 17 on the first annular ring 16.

In one embodiment, the second thread 19 of the second annular ring 17 is arranged projecting from an internal face of the second annular ring 17.

Hence, the coupling system enables holding and mutual compression of the lower shoulder 221 of the removable closure device 22 and of the upper shoulder 151 of the sleeve 15. Hence, screwing of the second annular ring 17 on the first annular ring 16 results in sealing the vessel 10.

In an embodiment that is not represented, the first thread 18 or the second thread 19 delimit a hard point so that when the second thread 19 is screwed into the first thread 18 before the hard point then the screwing force is substantially lower than is the case when screwing crosses the hard point. This is intended to indicate that screwing is fully tightened.

In another embodiment that is not represented, the first thread 18 delimits an end-of-stroke so that, when the second thread 19 is being screwed together with the first thread 18, then the mutual compression of the lower shoulder 221 of the removable closure device 22 and of the upper shoulder 151 of the sleeve 15 reaches an upper limit when the second thread 19 reaches the end-of-stroke.

According to a non-limiting embodiment, the container 11 delimits an outer shoulder 111 whose free face is generally orthogonal to the direction of longitudinal extension 152 of the sleeve 15. The second annular ring 17 also delimits a primary shoulder 171 so that the primary shoulder 171 of the second annular ring 17 bears against the outer shoulder 111 of the container 11 when the second annular ring 17 surrounds the lower shoulder 221 of the removable closure device 22 and the upper shoulder 151 of the sleeve 15 together with the first annular ring 16. Advantageously, this allows blocking the translation of the proximal end of the sleeve 15 between the first and second annular rings 16 and 17 so that a pressure on the vessel 11 could not take off the collar 161.

According to a non-limiting particular embodiment illustrated in FIG. 5, the lower shoulder 221 of the removable closure device 22 includes a planar face 221*a* and a flange 221*b* generally orthogonal to the planar face 221*a* so as to form a hook. The second annular ring 17 also delimits a secondary shoulder 172 away from the primary shoulder 171 whose shape is complementary to that delimited by the lower shoulder 221. Thus, when the second annular ring 17 surrounds the lower shoulder 221 of the removable closure device 22 and the upper shoulder 151 of the sleeve 15 together with the first annular ring 16, then the removable closure device 22 is blocked against at least one translational movement generally perpendicular to the longitudinal axis of extension 152 of the sleeve 15.

Figure 6:
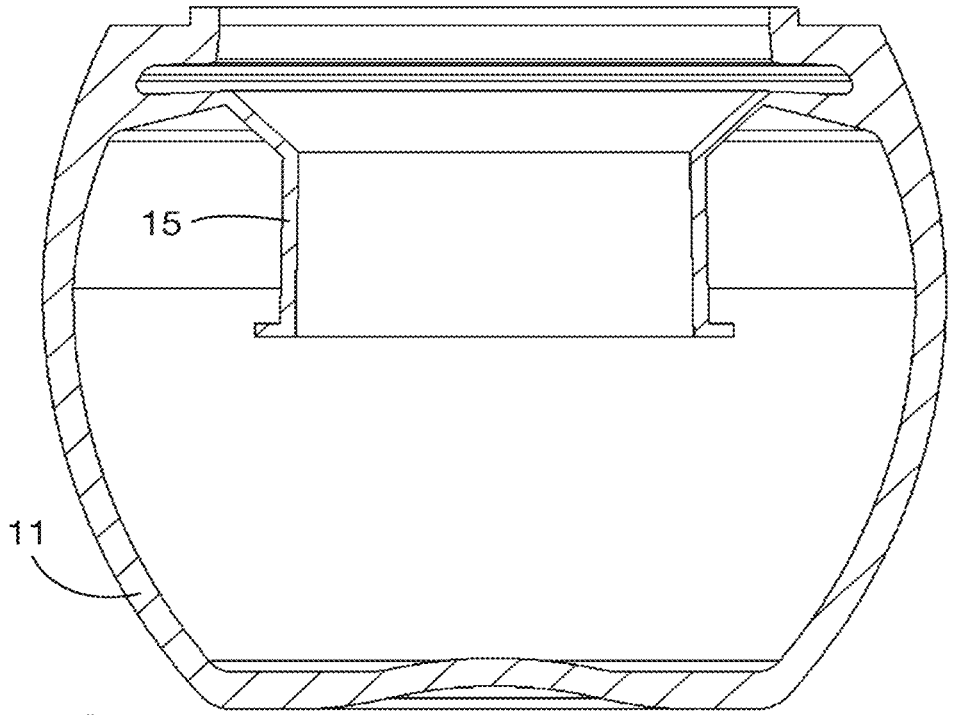
FIGS. 6 and 7 represent an axial sectional view of the container of the vessel according to a first position and according to a second position.
Figure 7:
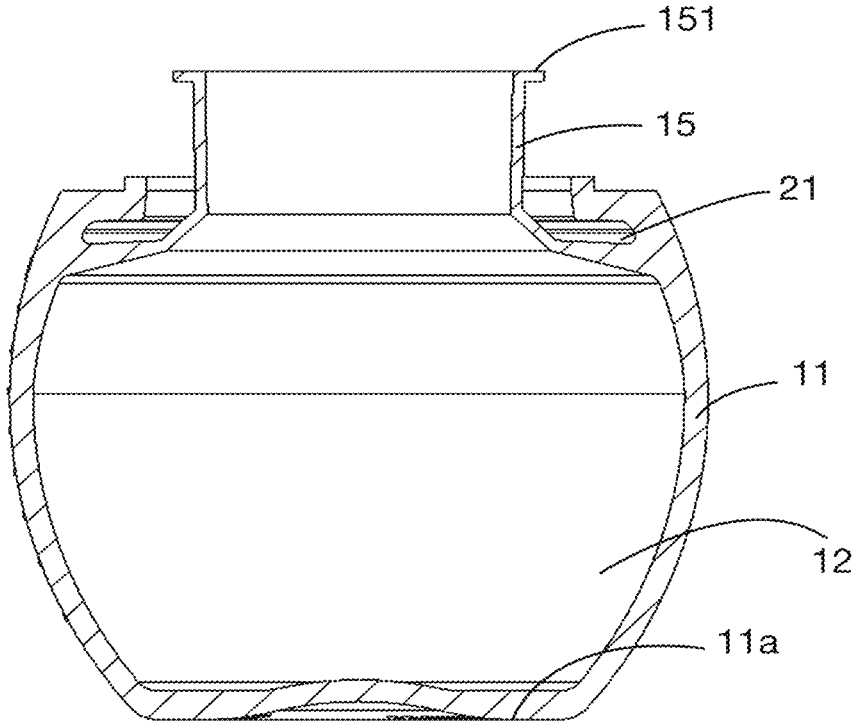

According to another non-limiting particular embodiment illustrated in FIGS. 6 and 7, the sleeve 15 is adapted to be selectively placed in at least one first raised position illustrated in FIG. 7 where the sleeve 15 is placed outside the container 11 and at least one second folded position where the sleeve 15 is folded inwards of the container 11 as illustrated in FIG. 6. Advantageously, this second position allows the possibility of reaching the bottom of the container 11 with the fingers for example advantageously to better clean the inside. Another advantage of his position is that it enables an easy mounting or dismounting of the first annular ring 16. Besides, this second position advantageously allows clearing access to the housing 21 for manual cleaning of the latter.

According to a non-limiting particular embodiment illustrated in FIG. 5, the walls of the tubular sleeve 15 have a thickness smaller than any one of the walls of the container 11. Advantageously, this allows conferring flexibility on the sleeve 15 and for example obtaining one of the previously-described positions.

According to another non-limiting particular embodiment illustrated in FIG. 4, at least one portion of the inner face of the inner volume 12 of the container 11 arranged towards the proximal end of the sleeve 15 describes a clearance angle 121 larger than 40° with respect to the direction of longitudinal extension 152 of the sleeve 15. Advantageously, this allows facilitating cleaning of the inside, improving flexibility of the sleeve for example to allow obtaining either one of the positions described hereinbefore but also facilitating pouring of the liquid contained in the internal volume 12.

According to a non-limiting particular embodiment illustrated in FIGS. 2 and 5, the container 11 has a general shape of a cambered cylinder whose generatrix has an arcuate shape such that the container 11 has a maximum diameter 28 substantially at the center of the height 29 of the container 11. Such a shape has the advantage of facilitating gripping of the vessel 10, which may be essential for infants or children.

According to a non-limiting particular embodiment illustrated in FIG. 5, the container 11 includes a support face 11*a* arranged so as to enable the container 11 to be set on a planar support in a stable way, the support face 11*a* having a corrugated central shape so that only the periphery of the support face 11*a* bears on the planar support.

In the example where the vessel is a feeding bottle, the vessel 10 may comprise a cap 20 adapted to be removably mounted on the second annular ring 17 so as to cover the teat.

Besides the already described advantages, the vessel 10 that has just been described is robust, hygienic, convenient to use and to clean, pleasant to touch, easy to manufacture, and is not restrictive with regards to the freedom of design of the container 11.

The invention claimed is:

1. A vessel to contain a fluid, the vessel comprising:

a container delimiting an inner volume made of a flexible material and topped with a tubular sleeve, a proximal end of the tubular sleeve delimits a housing in combination with the container, and a distal end of the tubular sleeve delimits an upper opening enabling a flow of the fluid towards or from the inner volume and an upper shoulder projects radially outwards from the tubular sleeve;

a removable closure device made of a flexible material, and including a lower shoulder adapted to interact with the upper shoulder of the tubular sleeve so that tightness is ensured when the lower shoulder and the upper shoulder are compressed against one another;

a coupling system enabling holding and mutual compression of the lower shoulder of the removable closure device and of the upper shoulder of the tubular sleeve, and constituted by a first annular ring and a second annular ring, each independent of each other and each being made of a rigid material:

the first annular ring delimiting a first thread and a collar adapted to be inserted into the housing by elastic deformation of the proximal end of the tubular sleeve, the first annular ring fitting around the tubular sleeve, beneath the upper shoulder, by elastic deformation of the upper shoulder;

the second annular ring delimiting a second thread meshing with the first thread by screwing of the second annular ring relative to the first annular ring, so that the lower shoulder of the removable closure device and the upper shoulder of the tubular sleeve are adapted to be tightly held and compressed together between the first annular ring and the second annular ring by the screwing action of the second annular ring on the first annular ring;

wherein the container delimits an outer shoulder having a free face that is generally orthogonal to a direction of longitudinal extension of the tubular sleeve, and the second annular ring delimits a primary shoulder so that the primary shoulder of the second annular ring bears against the outer shoulder of the container when the second annular ring surrounds the lower shoulder of the removable closure device and the upper shoulder of the tubular sleeve together with the first annular ring.

2. The vessel according to claim 1, wherein the second thread of the second annular ring projects from an internal face of the second annular ring.

3. The vessel according to claim 2, wherein the collar of the first annular ring projects from an external face of the first annular ring and the housing is arranged in a plane generally orthogonal to the direction of longitudinal extension of the sleeve so that the collar inserted into the housing is held blocked against at least one translational movement along the direction of longitudinal extension of the tubular sleeve.

4. The vessel according to claim 3, wherein the collar of the first annular ring has a thickness larger than a thickness of the housing considered according to the direction of longitudinal extension so that walls delimiting the housing are compressed by the collar when the collar of the first annular ring is inserted into the housing such that the first annular ring is held blocked against a rotational movement about the direction of longitudinal extension of the tubular sleeve.

5. The vessel according to claim 4, wherein the lower shoulder of the removable closure device includes a planar face and a flange generally orthogonal to the planar face so as to form a hook, and the second annular ring delimits a secondary shoulder away from the primary shoulder and whose shape is complementary to that delimited by the lower shoulder of the removable closure device so that when the second annular ring surrounds the lower shoulder of the removable closure device and the upper shoulder of the tubular sleeve together with the first annular ring, the removable closure device is blocked against at least one translational movement generally perpendicular to the direction of longitudinal extension of the tubular sleeve.

6. The vessel according to claim 5, wherein walls of the tubular sleeve have a thickness smaller than any one of a wall of the container.

7. The vessel according to claim 6, wherein the tubular sleeve is adapted to be selectively placed in at least one first raised position where the tubular sleeve is placed outside the container and at least one second folded position where the tubular sleeve is folded inwards of the container.

8. The vessel according to claim 7, wherein at least one portion of an inner face of the inner volume of the container arranged towards the proximal end of the tubular sleeve describes a clearance angle larger than 40° with respect to the direction of longitudinal extension of the tubular sleeve.

9. The vessel according to claim 1, wherein the collar of the first annular ring projects from an external face of the first annular ring and the housing is arranged in a plane generally orthogonal to the direction of longitudinal extension of the sleeve so that the collar inserted into the housing is held blocked against at least one translational movement along the direction of longitudinal extension of the tubular.

10. The vessel according to claim 1, wherein the collar of the first annular ring has a thickness larger than a thickness of the housing considered according to the direction of longitudinal extension so that walls delimiting the housing are compressed by the collar when the collar of the first annular ring is inserted into the housing such that the first annular ring is held blocked against a rotational movement about the direction of longitudinal extension of the tubular sleeve.

11. The vessel according to claim 1, wherein the lower shoulder of the removable closure device includes a planar face and a flange generally orthogonal to the planar face so as to form a hook, and the second annular ring delimits a secondary shoulder away from the primary shoulder and whose shape is complementary to that delimited by the lower shoulder of the removable closure device so that when the second annular ring surrounds the lower shoulder of the removable closure device and the upper shoulder of the tubular sleeve together with the first annular ring, the removable closure device is blocked against at least one translational movement generally perpendicular to the direction of longitudinal extension of the tubular sleeve.

12. The vessel according to claim 1, wherein walls of the tubular sleeve have a thickness smaller than any one of a walls of the container.

13. The vessel according to claim 1, wherein the tubular sleeve is adapted to be selectively placed in at least one first raised position where the tubular sleeve is placed outside the container and at least one second folded position where the tubular sleeve is folded inwards of the container.

14. The vessel according to claim 1, wherein at least one portion of an inner face of the inner volume of the container arranged towards the proximal end of the tubular sleeve describes a clearance angle larger than 40° with respect to the direction of longitudinal extension of the tubular sleeve.

15. The vessel according to claim 1, wherein the removable closure device comprises a teat.

16. The vessel according to claim 15, wherein the vessel comprises a cap adapted to be removably mounted on the second annular ring so as to cover the teat, the vessel constituting a feeding bottle intended to contain a liquid for its consumption through the teat.

17. The vessel according to claim 1, wherein the container partially delimits a general shape of a cambered cylinder whose generatrix has an arcuate shape such that the container has a maximum diameter substantially halfway-up a length of the container.

18. The vessel according to claim 1, wherein the container includes a support face arranged so as to enable the container to be set on a planar support in a stable way, the support face having a corrugated central shape so that only a periphery of the support face bears on the planar support.

19. The vessel according to claim 1, wherein the container and the closure device are made of a silicone.

20. The vessel as in claim 1, wherein the vessel is one of a feeding bottle, a bottle, a flask, and a tank for a gas or a liquid.

* * * * *